United States Patent [19]

Giragosian

[11] Patent Number: 4,536,981

[45] Date of Patent: Aug. 27, 1985

[54] FIREARM ASSEMBLY

[76] Inventor: Paul S. Giragosian, 66 Lake St., Arlington, Mass. 02174

[21] Appl. No.: 680,353

[22] Filed: Dec. 11, 1984

Related U.S. Application Data

[63] Continuation-in-part of Ser. No. 423,325, Sep. 24, 1982.

[51] Int. Cl.[3] ..... F41C 5/00; F41C 19/00

[52] U.S. Cl. ..... 42/69 B; 42/7; 42/70 F

[58] Field of Search ..... 42/7, 69 B, 70 F; 89/145

[56] References Cited

U.S. PATENT DOCUMENTS

| | | | |
|---|---|---|---|
| 196,781 | 11/1877 | Bovy | 42/75 D |
| 354,751 | 12/1886 | Tolley | 42/44 |
| 847,564 | 3/1907 | Fittipaldi et al. | 42/44 |
| 1,118,330 | 1/1914 | Carl | 42/75 A |
| 2,846,925 | 8/1958 | Norman | 42/69 B |
| 2,958,974 | 11/1960 | Sefried, II | 42/75 B |
| 3,016,646 | 1/1962 | Smith | 42/69 B |
| 3,363,303 | 1/1972 | Volkmar et al. | 42/70 F |
| 3,713,241 | 1/1973 | Dieckmann | 42/69 B |
| 4,306,487 | 12/1981 | Beretta | 42/70 F |

FOREIGN PATENT DOCUMENTS

| | | | |
|---|---|---|---|
| 497896 | 1/1951 | Belgium | 42/75 B |
| 0057733 | 8/1982 | European Pat. Off. . | |
| 90430 | 2/1897 | Fed. Rep. of Germany . | |
| 2108010 | 8/1972 | Fed. Rep. of Germany | 42/70 F |
| 786652 | 9/1935 | France . | |

*Primary Examiner*—Charles T. Jordan
*Assistant Examiner*—Ted L. Parr

[57] ABSTRACT

A firearm assembly comprising a frame assembly, a modular hammer and safety assembly, a slide receiver, and a barrel assembly, said hammer and safety assembly and said frame assembly having slide structures for cooperative connection to the slide receiver, the hammer and safety assembly further including an ejector mechanism, a hammer, a spring biasing the hammer, a sear for retaining the hammer in a cocked position, a disconnector assembly operable to prevent actuation of the sear during a cocking operation, and a safety device selectively moveable to a position preventing firing of the firearm, the slide receiver having safety actuator means thereon to actuate the hammer and safety assembly safety means, and having cam means thereon for actuation of the hammer and safety asssembly disconnector assembly, the hammer and safety assembly being interconnected such that the hammer and safety assembly may be withdrawn, or inserted into, the frame assembly as a unitary modular unit, the frame assembly being adapted to receive and releasably retain the barrel assembly.

2 Claims, 16 Drawing Figures

FIREARM ASSEMBLY

This application is a continuation-in-part application of U.S. patent application Ser. No. 423,325 filed Sept. 24, 1982.

BACKGROUND OF THE INVENTION

1. Field of the Invention

The invention relates to firearms and is directed more particularly to a firearm assembly including a frame assembly, modular hammer and safety assembly, a slide receiver, and a barrel assembly.

2. Description of the Prior Art

In breaking down semi-automatic pistols of the type disclosed in U.S. Pat. No. 1,070,582, issued Aug. 19, 1913 to J. M. Browning, and generally referred to as the conventional Colt Government Model .45, an operator is faced with a multitude of individual components, all of which must be carefully kept track of and carefully returned to their rightful positions in the handgun.

In an attempt to adapt handguns to accepting more than a single caliber of cartridge, interchangeable components have been introduced. In U.S. Pat. No. 2,090,657, for example, issued Aug. 24, 1937 to D. M. Williams, there is shown and described a modified pistol of the '582 type having a subcaliber barrel and slide which may be substituted for the standard parts to enable subcaliber ammuninition to be used.

In an attempt to make conversions as convenient as possible, there have been provided various components in modular form, such as complete barrel assemblies, slide-receiver assemblies, frame and trigger assemblies, and the like, affording quick and easy interchangeability of packages of components.

In some instances of conversion, it is necessary to adapt the hammer assembly and/or safety assembly to the "new" slide assembly. By and large, such components constitute a multiplicity of parts, mostly small in size, easily lost, and certainly not quick and easy to disassemble and reassemble.

There is a need for a firearm having interchangeable subassemblies to accommodate different calibers of ammunition, and in particular, a modular assembly of hammer and safety components adapted to be handled by an operator as a single unit.

SUMMARY OF THE INVENTION

An object of the invention is to provide a firearm assembly including a frame assembly adapted for cooperation with interchangeable barrel assemblies, slide receivers, and modular hammer and safety assemblies, the components of the hammer and safety assembly being so interconnected that the hammer and safety assembly may be withdrawn, or inserted into, the frame assembly as a unitary modular unit.

With the above and other objects in view, as will hereinafter appear, a feature of the present invention is the provision of a firearm assembly including a frame assembly, a slide receiver, a barrel assembly and a modular hammer and safety assembly, the hammer and safety assembly comprising a housing, a slide means extending from the housing for interconnection with the slide receiver, an ejector means fixed to the housing, a hammer pivotally mounted in the housing, spring means disposed in the housing and biasing the hammer toward a firing position, a sear pivotally mounted in the housing and adapted to engage the hammer and retain the hammer in a cocked position against the spring bias, a disconnector means slidably mounted in the housing and operable to prevent actuation of the sear during a cocking operation, and a safety means mounted in the housing and selectively moveable between a first inactive position to a second position in which the safety means prevents firing of the firearm, the slide receiver having safety actuator means thereon for engaging the hammer and safety assembly safety means, and cam means thereon for engagement with the hammer and safety assembly disconnector means, the hammer and safety assembly being interconnected such that the hammer and safety assembly may be withdrawn, or inserted into, the frame assembly as a unitary modular unit.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
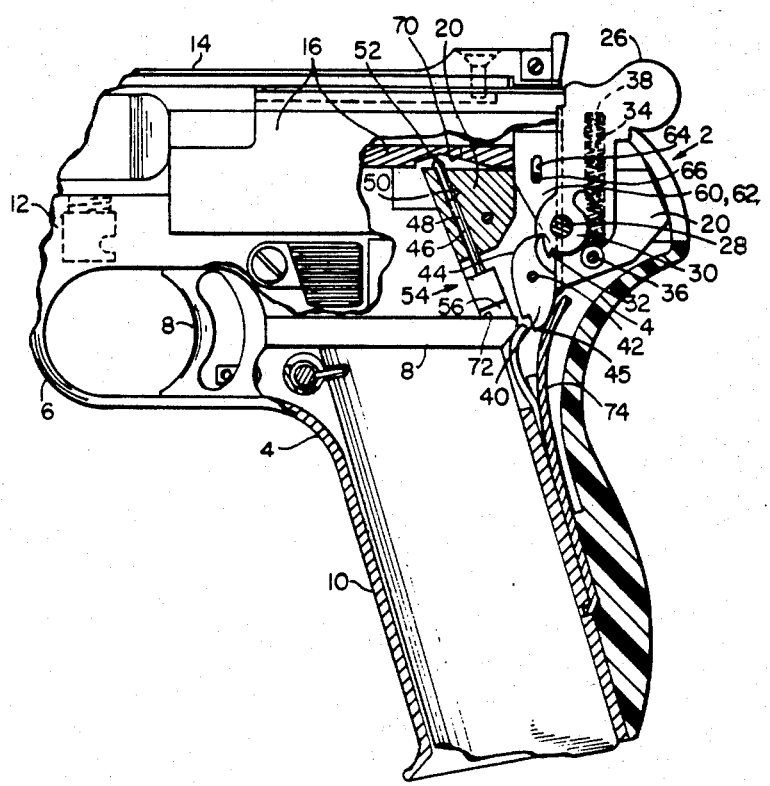
FIG. 1 is a side elevational view of a portion of a firearm assembly with parts broken away, showing the frame assembly, the slide receiver, the barrel assembly (in part) and the modular hammer and safety assembly, illustrative of an embodiment of the invention, in place in the firearm, parts of the assemblies being shown in section to more clearly show the various components thereof, the hammer and safety assembly being shown in "at rest" position without the safety engaged.

Referring to the drawings, it will be seen that the illustrative hammer and safety assembly 2 is disposed in a pistol including a frame assembly 4 having as portions thereof a trigger guard 6, a trigger mechanism 8, a grip portion 10, and a barrel mounting portion 12. The pistol further includes a barrel assembly 14 connectable to the barrel mounting portion 12 and a slide receiver 16 slidably received by and mountable on the frame assembly.

Figure 9:
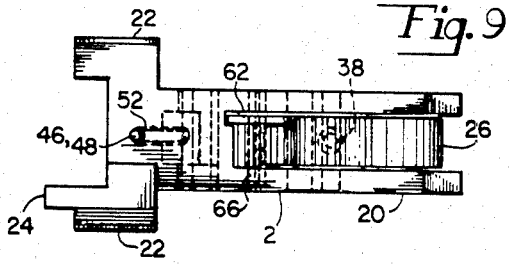
FIG. 9 is a top plan view of the illustrative hammer and safety assembly.
Figure 10:
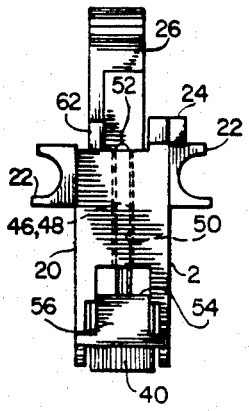
FIG. 10 is a front elevational view of the hammer and safety assembly.
Figure 11:
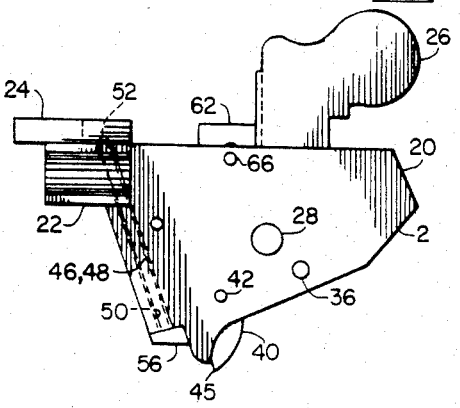
FIG. 11 is a side elevational view of the hammer and safety assembly.
Figure 13:
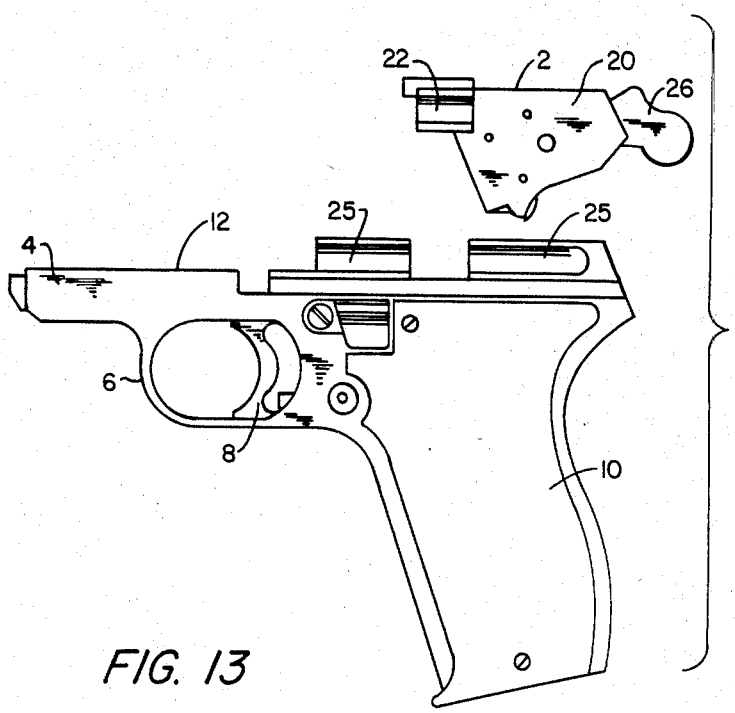
FIG. 13 is a side elevational view illustrative of the manner in which the hammer and safety assembly is inserted into the frame assembly.
Figure 14:
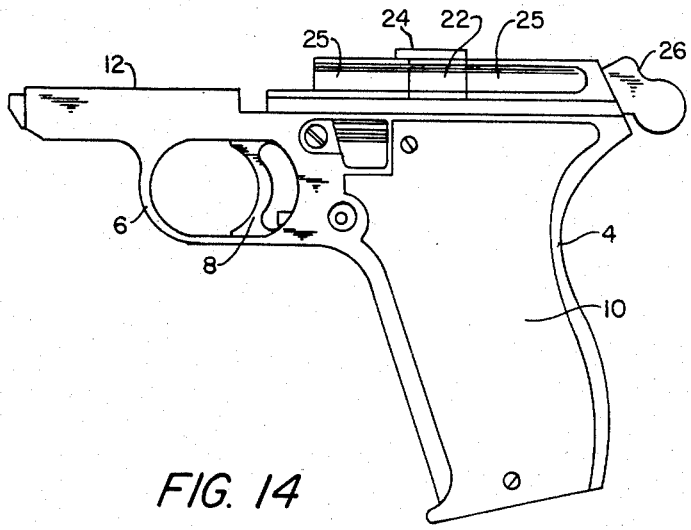
FIG. 14 is similar to FIG. 13, but shows the hammer and safety assembly in place in the frame assembly.
Figure 15:
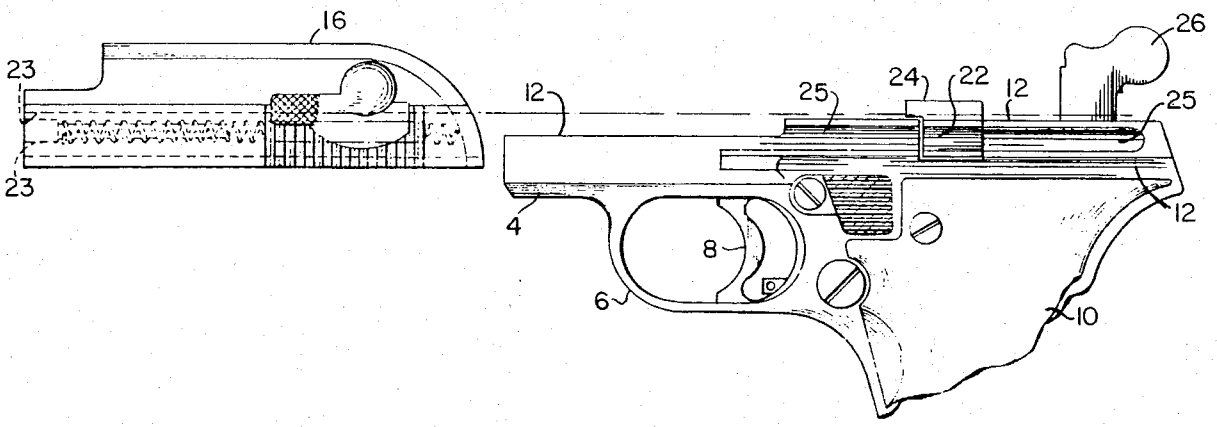
FIG. 15 is a side elevational view illustrative of the manner in which the combination of the frame assembly and hammer and safety assembly are adapted to receive the slide assembly.
Figure 16:
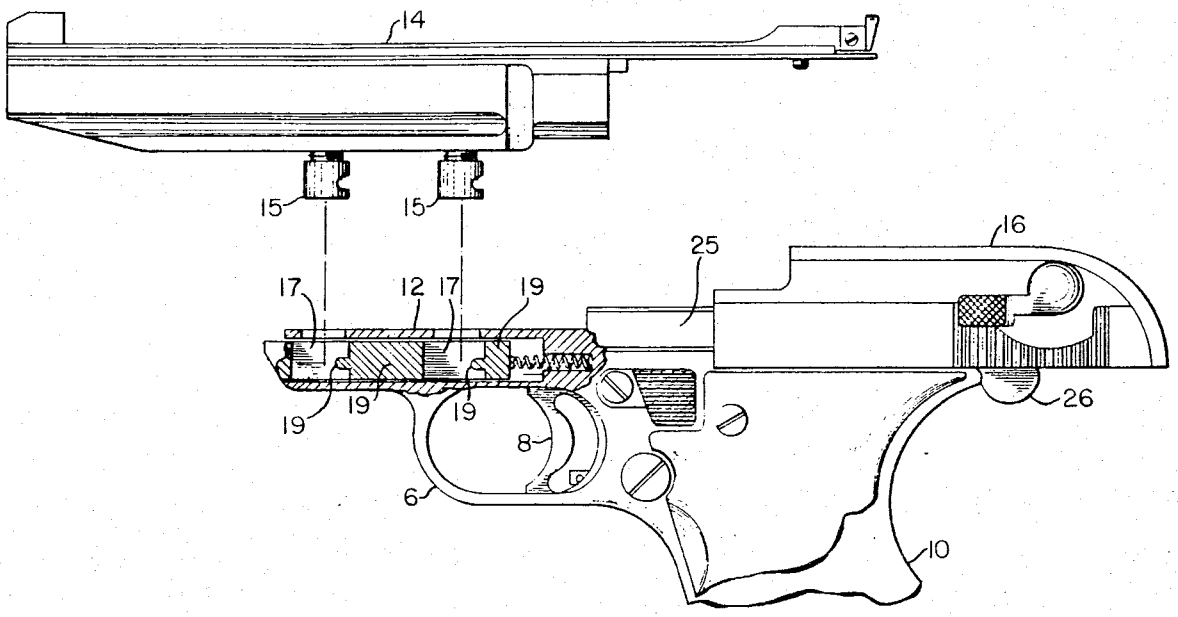
FIG. 16 is a side elevational, partly sectional, view illustrative of the manner in which the combination of the frame assembly, hammer and safety assembly, and slide receiver are adapted to receive the barrel assembly.

The modular hammer and safety assembly 2 includes a housing 20 having extending therefrom a slide means 22 (FIGS. 13, 14, 15) adapted to interconnect with a slide means 25 on the frame assembly 4 for sliding interconnection with slide means 23 of the slide receiver 16 (FIG. 9), the slide receiver thereby locking the hammer and safety assembly 2 in place in the frame assembly 4. In assembly, the hammer and safety assembly 2 is inserted in the frame assembly 4, as shown in FIGS. 13 and 14, such that the respective hammer and safety, and frame, slide means 22, 25 are aligned. The slide member 16 in then slid onto the combined frame and hammer and safety assemblies by sliding engagement of the slide means 23 with the aligned slide means 22,25, as shown in FIG. 15. The barrel assembly 14 is then connected to the barrel mounting portion 12 of the frame assembly 4 by insertion of posts 15 in holes 17 in the barrel mounting portion 12, which is provided with a lock means 19 for securing the posts 15 in the holes 18, thereby locking the barrel assembly to the frame assembly as shown in FIG. 16, while the slide receiver 16 locks together the frame and hammer and safety assemblies 4, 2. Also extending from the housing 20 is an ejector means 24 (FIG. 9). A hammer 26 is pivotally mounted in the housing 20 by a pin 28 disposed centrally of a pawl portion 30 of the hammer 26. The pawl portion 30 is provided with teeth 32 on a portion of its periphery. A spring 34 is mounted on a pin 36 in the housing 20 and extends into a recess 38 in the hammer 26. The spring 34 biases the hammer forwardly, or leftwardly as viewed in FIG. 1.

A sear 40 is pivotally mounted in the housing 20 by a pin 42. A first end 44 of the sear 40 is adapted to engage the teeth 32 of the hammer pawl portion 30; a second end 45 of the sear 40 is adapted to be engaged by the trigger mechanism 8. Thus, the sear 40 interconnects the trigger mechanism 8 and the hammer 26.

A disconnector means 46 is disposed in the housing 20 and comprises a pin 48 slidably disposed in a bore 50 in the housing 20. The pin 48, at a first end 52 thereof is engageable with the slide receiver 16, and at a second end 54 thereof carries a pusher member 56 operable to divert movement of the trigger mechanism 8 during a cocking operation, as will be further explained below.

Figure 3:
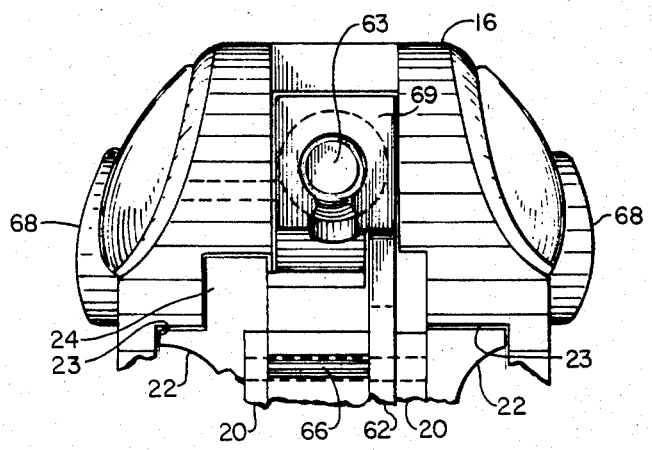
FIG. 3 is a rear elevational view of a portion of the assembly shown in FIG. 2.
Figure 8:
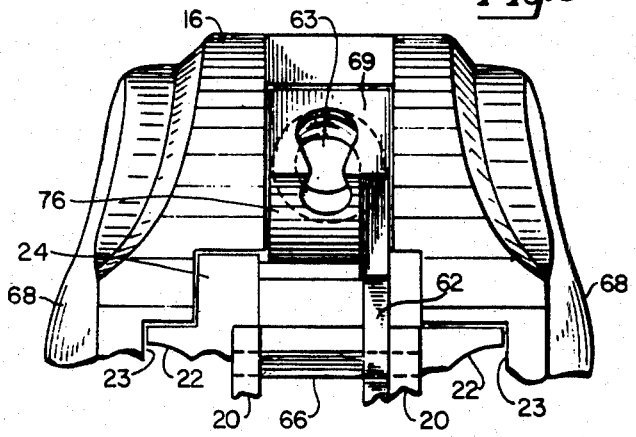
FIG. 8 is a rear elevational view similar to FIG. 3 but shows the assembly in an alternative position.
Figure 12:
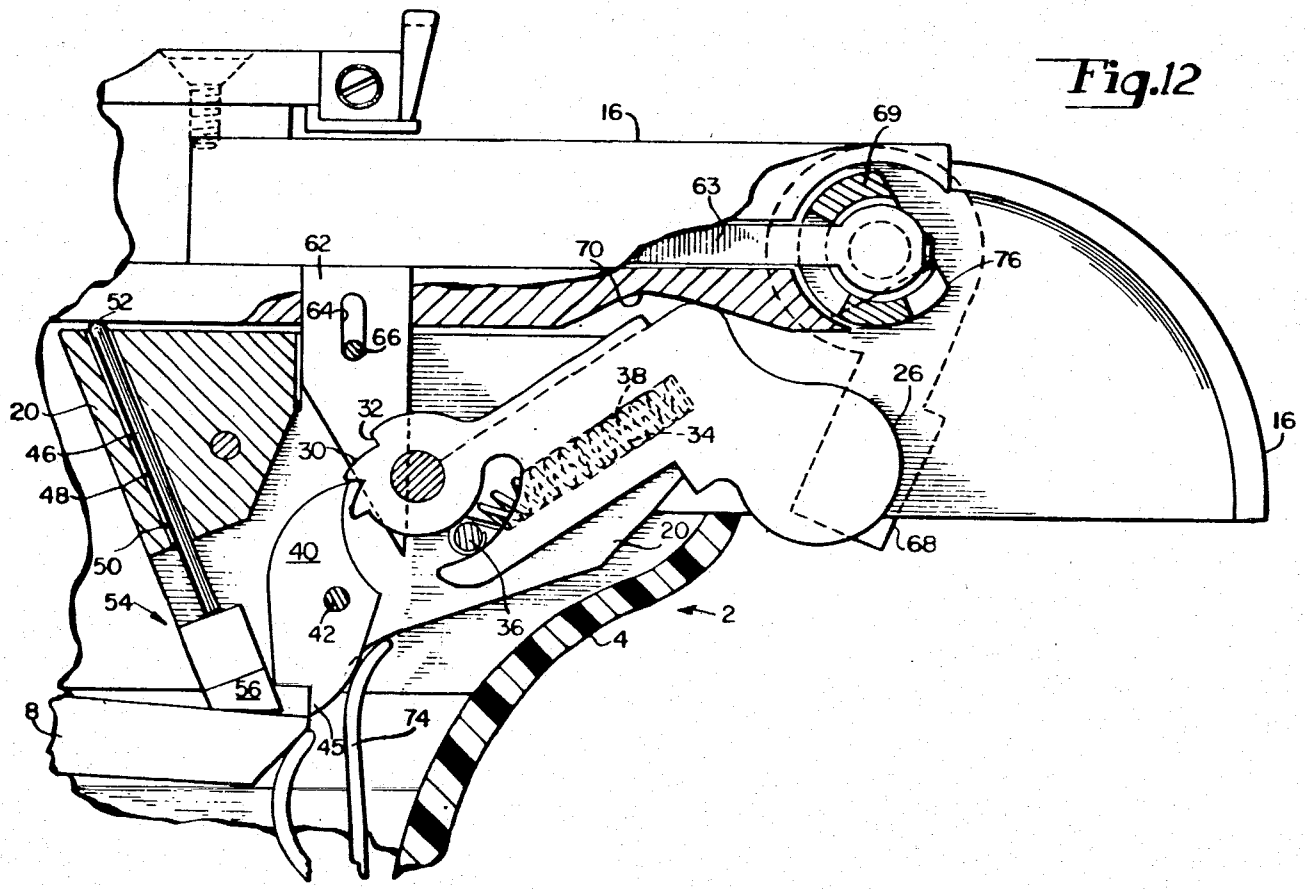
FIG. 12 is a side elevational view similar to FIGS. 2, 5 and 7, but showing the assembly in a cocking position with the safety actuated.

A safety means 60 is mounted in the housing 20 and includes a reciprocally moveable plunger 62 engageable with the sear 40 to separate the sear and the hammer pawl portion, releasing the hammer but shielding a firing pin 63, as will be further discussed below. The plunger 62 has a slot 64 therein in which is disposed a pin 66, the slot and pin arrangement permitting movement of the plunger selectively toward and away from the sear 40. An actuating lever 68 (FIG. 12) may be located on the side of the slide receiver 16 and be operatively connected to the plunger, as by a rotatable cam means 69, to serve as an actuator for the safety plunger. As shown in FIGS. 3 and 8, it is preferable that an actuating lever 68 be disposed on each side of the slide receiver 16 to facilitate manipulation by either hand of an operator.

Figure 2:
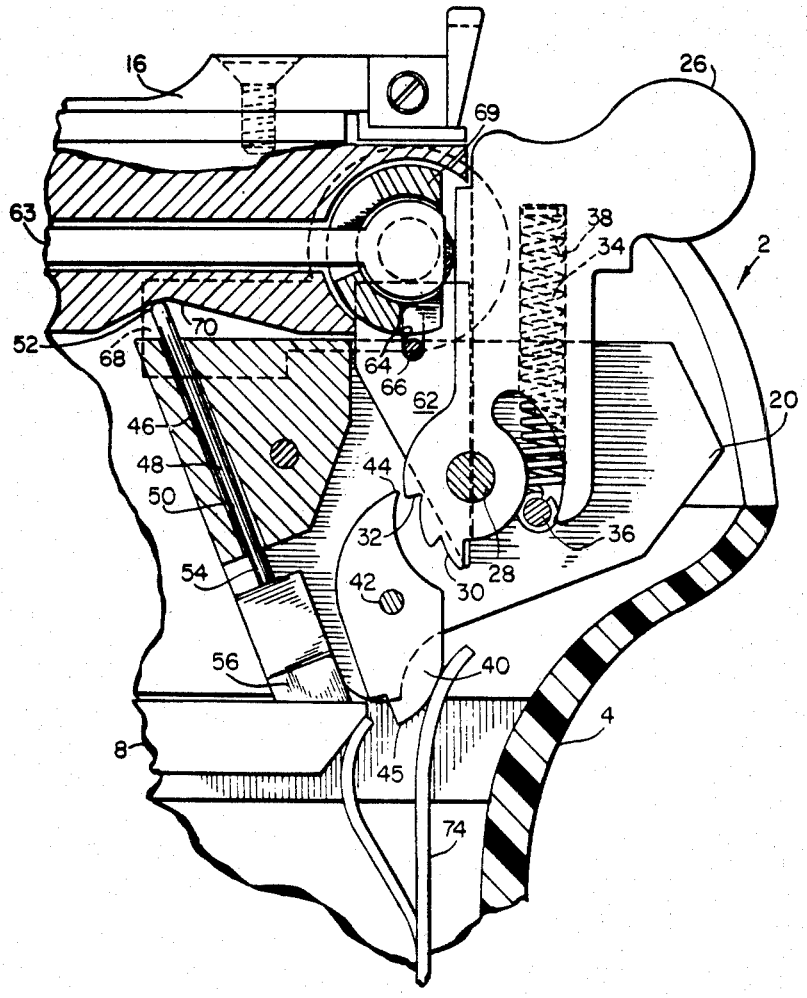
FIG. 2 is an enlarged side elevational view of portions of FIG. 1, with additional components shown.

In FIGS. 1 and 2, the firearm is shown at rest, with the safety in the inactive, or raised, position. The hammer 26 is in a forward position, biased forwardly by the spring 34. The first end 52 of the disconnector pin 48 is disposed in a recess 70 in the slide receiver 16.

Figure 4:
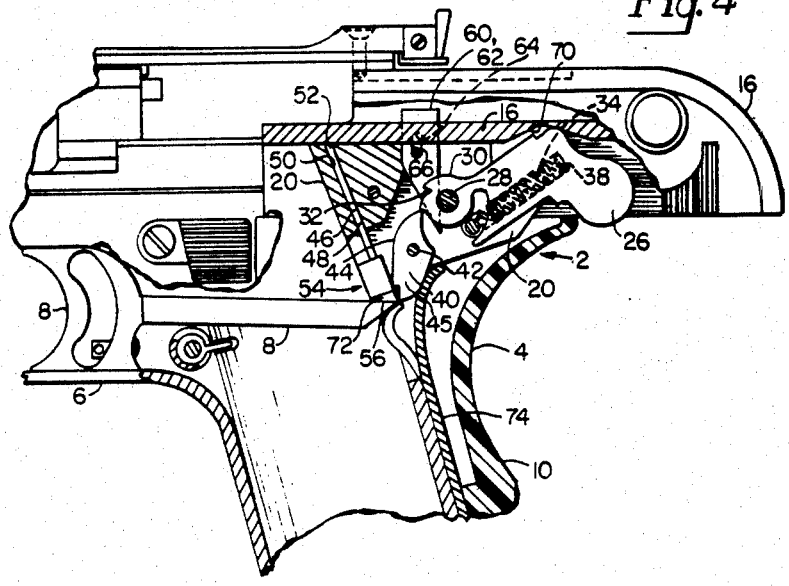
FIG. 4 is similar to FIG. 1, but shows the assembly in a cocking position.

To cock the piece, the slide receiver is moved rearwardly by an operator to the position shown in FIG. 4. Referring particularly to FIG. 4, it will be seen that the rearward movement of the slide receiver 16 has forced the disconnector pin 48 out of the recess 70 and downwardly, causing the pusher member 56 at the second end 54 of the disconnector pin 48 to bear against the trigger mechanism 8, pushing the trigger mechanism downwardly and out of alignment with the sear 40. At this point, pressure applied to the trigger by the operator will fail to actuate the hammer. The rearward movement of the slide receiver 16 relative to the hammer and safety assembly 2, has further caused the hammer to pivot upon pin 28, against the bias of the spring 34 to the position shown in FIG. 4. The toothed portion 32 of the pawl portion 30 of the hammer has been engaged by the first end 44 of the sear 40, holding the hammer in a rearward position, as shown. A leaf spring 74 extending from the frame assembly 4 bears against the sear 40 and exercises a steadying and holding influence thereon.

Figure 5:
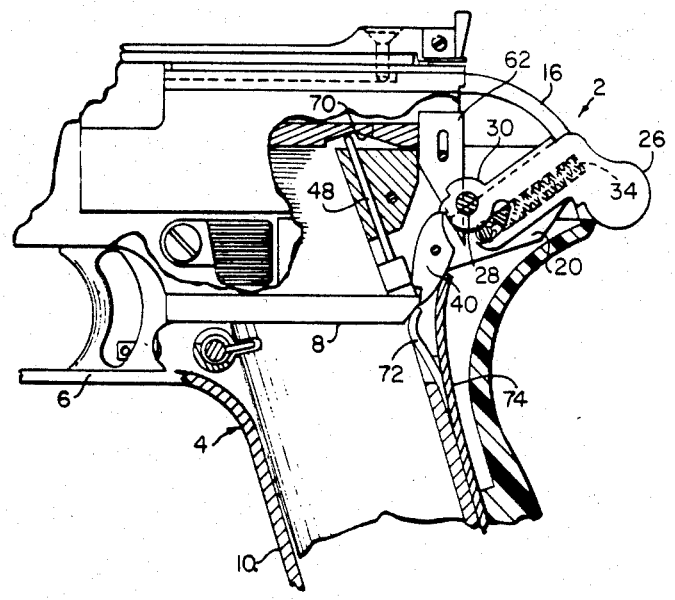
FIG. 5 is similar to FIG. 4, but shows the assembly in a cocked position.
Figure 6:
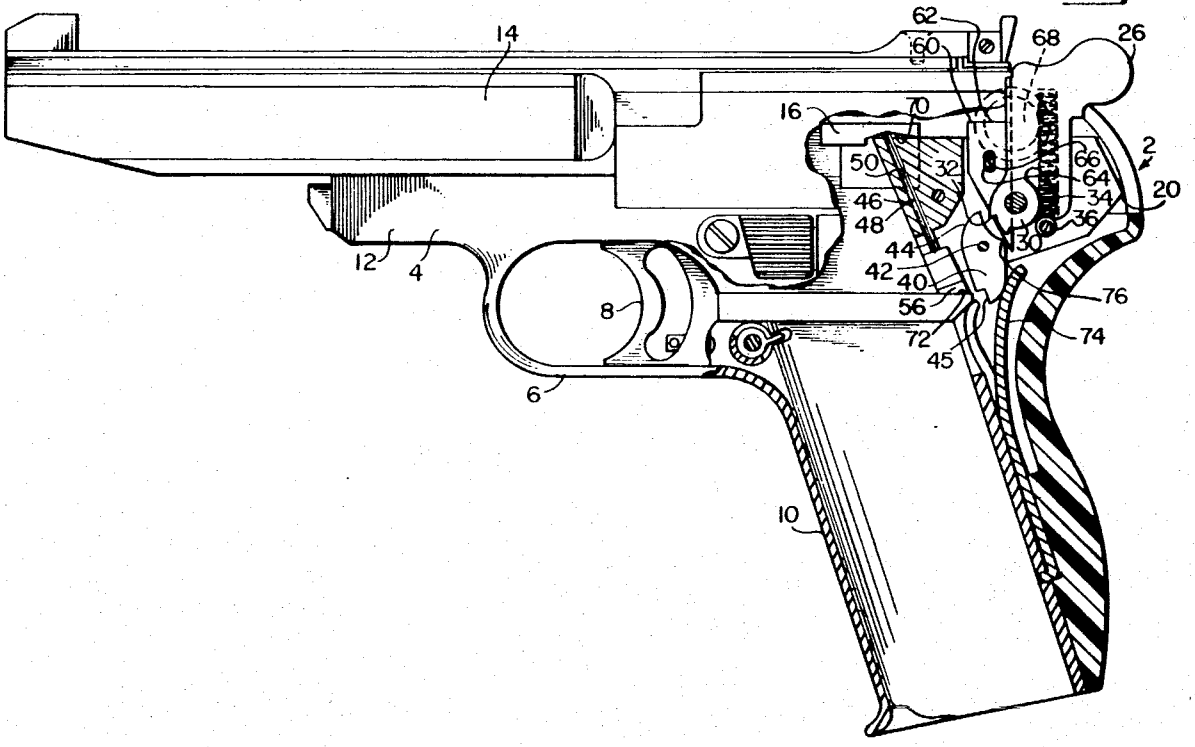
FIG. 6 is similar to FIGS. 1 and 2, but shows the assembly in a safety "on" position.

When the slide receiver 16 returns to its forwardmost position (FIG. 5), the disconnector pin 48 is positioned to re-enter the slide recess 70. A trigger spring 72 urges the trigger mechanism 8 back to its normal position, which in turn urges the disconnector pin 48 back into the slide recess 70.

Figure 7:
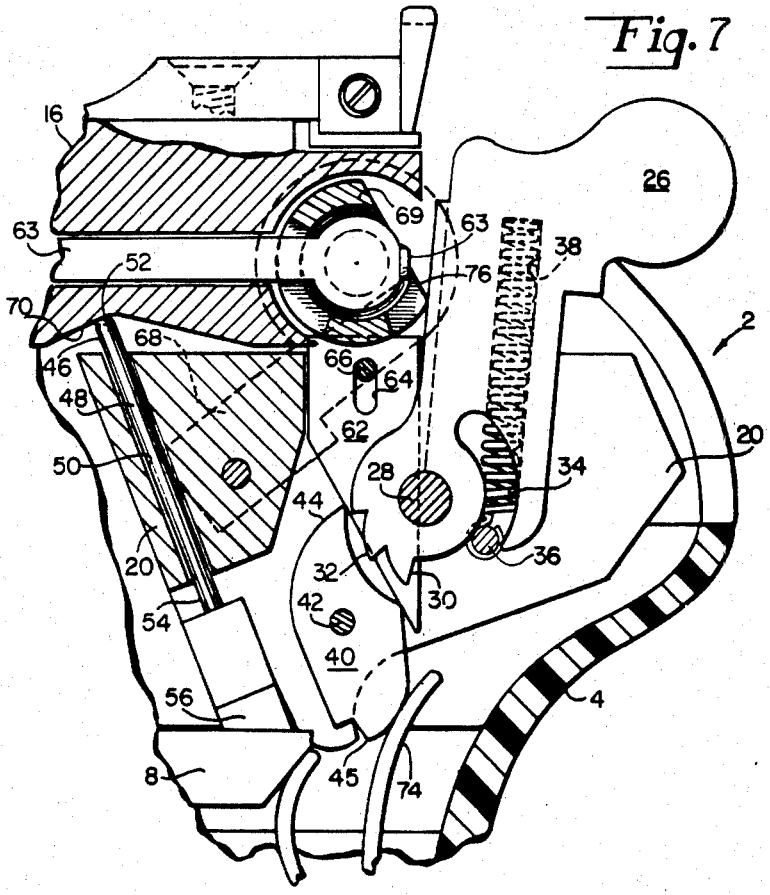
FIG. 7 is an enlarged side elevational view, similar to FIG. 2, but shows the safety "on", and illustrates the complementary operation of the slide receiver and hammer and safety assembly.

At this point, if it is not desired to fire the piece, the actuator lever 68 may be rotated to move the safety plunger 62 into abutting engagement with the sear 40, separating the sear from the pawl portion 30 of the hammer 26, thereby releasing the hammer and permitting the hammer to pivot forwardly under the influence of the spring 34 (FIG. 7). Turning the safety actuating lever 68 serves to rotate the cam means 69, as aforementioned, which serves to move cam stop means 76 into a position protecting the firing pin 63 from contact by the hammer 26 (FIG. 7). Thus, the actuation of the safety causes the hammer to move forwardly, but prevents the hammer from striking the firing pin. To fire the pistol, it is necessary to release the safety and recock the pistol.

Upon firing of the pistol, expansion of gases causes rearward movement of the slide receiver 16 to cock the pistol and repeat the above cycle. As the slide receiver proceeds rearwardly the slide receiver and the ejector means 24 cooperate to remove a spent cartridge from the chamber of the gun, in accordance with known methods. If the safety is "on" and an operator attempts to cock the piece, the engagement of the plunger 62 with the sear 40 prevents retention of the hammer 26 in a rearward cocked position, the hammer merely returning to the forward position, engaging the stop means 76 and prevented thereby from engaging the firing pin 63.

If it is desired to convert the pistol to a different caliber, the required interchange components are removed from the frame assembly and new components are attached thereto. That is, the lock means 19 is manipulated by an operator to release the barrel assembly 14. The slide receiver 16 is then removed by sliding forwardly, or leftwardly as viewed in the drawing. The hammer and safety assembly 2 is then removed from the frame by ifting upwardly, as viewed in FIG. 13. To facilitate operation with a different caliber of ammunition, a "new" hammer and safety assembly, slide receiver, and barrel assembly are attached, as above described, to the frame 4. The entire hammer and safety assembly is removable and insertable as a single unit.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A firearm assembly comprising a frame assembly, a modular hammer and safety assembly, a slide receiver, and a barrel assembly, said hammer and safety assembly comprising a housing, slide means extending from said housing, hammer means mounted in said housing, disconnector means slidably mounted in said housing, and safety means mounted in said housing, said frame assembly having slide means thereon adapted for alignment with said hammer and safety assembly slide means to cooperatively constitute an elongated uninterrupted slide means adapted to receive said slide receiver, said slide receiver having slide means thereon for slidable engagement with said combined frame assembly and hammer and safety assembly slide means, whereby to lock said hammer and safety assembly in said frame assembly, safety actuator means thereon operable to engage said hammer and safety assembly safety means, and cam means thereon for engagement with said hammer and safety assembly disconnector means, said barrel assembly having means thereon for attachment to said frame assembly, said frame assembly having means thereon for releasably retaining said barrel assembly.

2. A firearm assembly comprising a frame assembly, a modular hammer and safety assembly, a slide receiver, and a barrel assembly, said hammer and safety assembly comprising a housing, slide means extending from said housing, ejector means fixed to said housing, a hammer pivotally mounted in said housing, spring means disposed in said housing and biasing said hammer toward a firing position, a sear pivotally mounted in said housing and adapted to engage said hammer and retain said hammer in a cocked position against said spring bias, a disconnector means slidably mounted in said housing and operable to prevent actuation of said sear during a cocking operation, and safety means mounted in said housing and selectively movable between a first inactive position and a second position in which said safety means prevents firing of the firearm, said frame assembly having slide means thereon adapted for alignment with said hammer and safety assembly slide means to cooperatively constitute an elongated uninterrupted slide means adapted to receive said slide receiver, said slide receiver having slide means thereon adapted for slidable engagement with said frame assembly slide means and said hammer and safety assembly slide means, safety actuator means accessible for manipulation by an operator and operable to engage said hammer and safety assembly safety means for selective actuation of said safety means, and cam means for engagement with said disconnector means and operation thereof, said hammer and safety assembly being interconnected such that said hammer and safety assembly may be withdrawn, or inserted into, said frame assembly as a unitary modular unit, said slide receiver being adapted to lock said hammer and safety assembly to said frame assembly, said frame assembly further having a barrel mounting portion, and lock means for releasably locking said barrel assembly to said barrel mounting portion.

* * * * *